United States Patent [19]

Lockard et al.

[11] Patent Number: 4,901,482

[45] Date of Patent: Feb. 20, 1990

[54] MULTI-BUILDING DRIVE THROUGH MALL

[76] Inventors: Carleen L. Lockard, 3900 Rose Hill, Apt. 402A, Cincinnati, Ohio 45229; Thomas W. Hefley, 1275 Ida St., Cincinnati, Ohio 45202

[21] Appl. No.: 351,014

[22] Filed: May 12, 1989

[51] Int. Cl.[4] ..... E04H 3/04

[52] U.S. Cl. ..... 52/33; 52/169.2; 52/174

[58] Field of Search ..... 52/169.1, 1692, 169.3, 52/174, 33

[56] References Cited

U.S. PATENT DOCUMENTS

| | | | |
|---|---|---|---|
| D. 231,777 | 6/1974 | Glasbrenner | 52/169.2 X |
| 1,473,709 | 11/1923 | Otis . | |
| 2,405,294 | 8/1946 | Delucchi . | |
| 2,638,636 | 5/1953 | Pool | 52/33 |
| 3,417,526 | 12/1968 | Lawson | 52/169.3 |
| 3,451,261 | 6/1969 | Olsen . | |

OTHER PUBLICATIONS

Article: "Window of Opportunity" *Identity, Fall 1988, p. 47.*

Advertisement: *Nations Restaurant News,* Mar. 27, 1989, p. 49.

Article: "Design Standards and Data" copyright 1953 by Harold R. Sleeper, F.A.I.A., pp. 168–171.

*Primary Examiner*—Carl D. Friedman

*Assistant Examiner*—Anthony W. Williams

*Attorney, Agent, or Firm*—Wood, Herron & Evans

[57] ABSTRACT

A drive-through shopping establishment having multiple buildings for ordering and purchasing goods. The shopping establishment may contain vendors of related goods, such as ready-to-eat food products, which permit the motorist to purchase one or more food products from different vendors from the comfort of his vehicle.

13 Claims, 1 Drawing Sheet

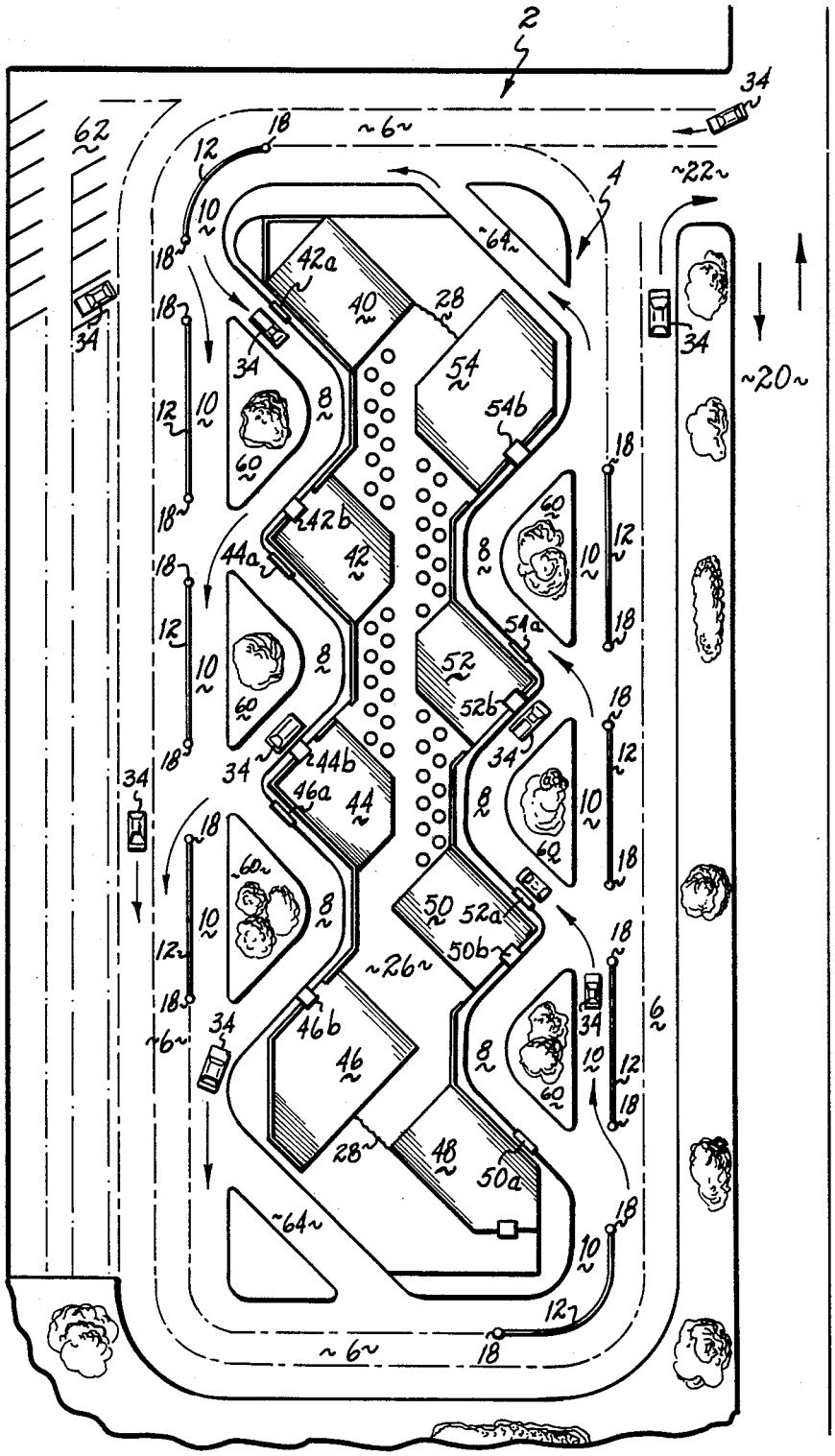
2
4
6
8
10
12
18
20
22
26
28
34
40
42
42a
42b
44
44a
44b
46
46a
46b
48
50
50a
50b
52
52a
52b
54
54a
54b
60
62
64

MULTI-BUILDING DRIVE THROUGH MALL

FIELD OF THE INVENTION

The invention relates to a shopping establishment comprised of multiple buildings for transacting both orders and purchases from the comfort and convenience of one's vehicle.

BACKGROUND OF THE INVENTION

Increasingly, retail sales outlets are becoming more specialized as to the type and variety of goods that are sold. Where once a single department store would be adequate to address all the purchasing needs of a family, now that is perceived as being inadequate. As a result, individual retail outlets are now in business selling only specialty items such as maternity clothes, athletic shoes, perfumes, greeting cards, leather goods, athletic clothing, and the like. This phenomenon is also noted in the ready-to-eat food product market, otherwise known as the fast food business. Where once a family could patronize a single restaurant which would provide a variety of entrees to satisfy the individual tastes of the family members, now most restaurants specialize in the types of food that are offered. Separate restaurants now exist for selling roast beef products, hamburgers, pizza, oriental food, Mexican food, chicken, fish, and the like.

It is a further feature of our mobile society that fast food can be obtained without leaving the confines of one's car. Most fast food restaurants now have drive-through windows which allow speedy pick-up of the food product for eventual consumption in the car, the home or other location. However, if one member of the family desires for example a roast beef product, while other members desire Mexican, oriental, chicken or other foods, then the driver is forced to locate various restaurants having drive-through facilities. These facilities may be separated by a space of several miles, and further are typically located on busy thoroughfares which make entrance onto and exit therefrom somewhat dangerous.

SUMMARY OF THE INVENTION

The invention as described herein relates to a shopping establishment comprised of multiple buildings which allow the transacting of orders and the purchase of items from the comfort and safety of the automobile or other vehicle without the need for driving great distances and without the increased risk of traffic accident caused by entering and leaving busy thoroughfares. Specifically, multiple discrete buildings are grouped in specific relationship to each other on a single plot of land with predetermined through lanes, vehicle stack lanes, and ordering lanes. The buildings are arranged in a manner such that one places an order at a first building and then proceeds along the ordering lane to receive the ordered item from a second building. The second building is equipped with an ordering station for pick-up of goods at a third building, and so on.

This concept may be employed advantageously for grouping any of various types of retail or wholesale sales outlet, but is considered to be particularly useful in grouping various fast food outlets within a single area.

It is an object of this invention to provide a shopping establishment comprised of multiple buildings for transacting orders and purchases from the comfort of one's vehicle.

It is a further object of the invention to provide a shopping establishment wherein orders and purchases may be transacted from the comfort and convenience of one's vehicle with a variety of vendors.

It is yet a further object of the invention to provide a method of shopping for food items for other goods from the comfort of one's vehicle within a road circulation pattern which minimizes the risk of serious traffic accidents.

These and other objects and advantages of the invention are more fully described below in the specification and drawing, in which:

DESCRIPTION OF THE DRAWING

The FIGURE is a top plan view of a drive-through mall designed for multiple fast food outlets.

DETAILED DESCRIPTION OF THE INVENTION

The invention in its broader aspects relates to a multi-building shopping establishment for purchasing goods from various vendors from within a vehicle, comprising a plot of land with public road access thereto; a central complex on the plot of land having a plurality of discrete buildings wherein both the ordering and the receiving of goods is accomplished, wherein an order for goods is placed at a building separate from the building at which the goods are received; a throughway inside the perimeter of the plot of land connected to the public road; at least one ordering lane between the complex and the throughway, connecting the building at which the order is placed with the building at which the goods are received; and a stack lane between the ordering lane and the throughway for accepting additional vehicles prior to the placing of orders for the goods. For purposes of this invention, the term buildings are meant to encompass unitary spaces wherein which individual vendors transact business. Thus, "building" would include individual separately identified modular areas, separate free-standing structures, and the like. One application for this type of establishment is in the offering of ready-to-eat food products, i.e., fast food and/or mid-scale, from each of the buildings within the establishment.

It is preferred that each of the ordering lanes within the establishment or mall have a V-shape which is defined by adjacent buildings on one side of the lane and a border area on the opposite side of the lane. Also, it is preferred that the combination of the stack lane and ordering lane be of a length sufficient to hold up to seven automobile in a safe holding pattern short of the pick up station.

In an effort to maximize the use of expensive commercial property, the shopping establishment in its preferred form is laid out preferably in a rectangular pattern, with the throughway having a rectangular shape following the perimeter of the plot of land. In this configuration, it can be seen that the ordering lanes present a saw tooth shape along the inside of the throughway.

With the buildings of the eating establishment arranged in such manner as to provide the saw tooth shape of the ordering lanes, there may be disposed within the grouping of buildings a commons area which may be filled with landscaping, benches and chairs, fountains, and the like. Where the establishment houses fast food restaurants, this commons area may be utilized as a sit down eating area. In the preferred embodiment, the saw tooth arrangement ultimately results in an eating area consisting of a number of angled sections along its entire length. Such an arrangement provides for a more intimate eating experience. Even if other non-food vendors occupy the drive-through mall, the angled appearance of the commons area promotes a desirable sense of privacy. It is envisioned that a mix of fast food and non-food retail outlets may be combined according to the teachings of this invention.

Referring to the drawing, the shopping establishment 2 is comprised of a central complex 4, throughway 6, ordering lanes 8, and stack lanes 10. Stack lanes 10 are separated from the throughway 6 by barriers 12, typically comprised of one or more guard rail units. At the ends of the barriers 12 are preferably positioned lighted bollards 18 which aid the motorist in determining where the stack lanes are located.

In the figure as depicted, the throughway 6 extends completely around the central complex 4 and accesses public road 20 via driveway 22 at a single point. The throughway 6 may also be accessed by a plurality of entrances from one or more public roads. Alternatively, it can be seen that the shopping establishment 2 may be positioned to occupy the entire space between parallel public roads in such a way that the throughway 6 be in fact two separate strip roads connecting with the public roads at both ends.

The commons area 26 may be accessed via entry ways 28 situated at either end of the central complex 4. Where the vendors are all fast food restaurants, the commons area is preferably arranged to allow sit down eating along up to the entire length thereof. Where vendors of other goods are doing business within the central complex, the commons area may be used as a resting place, a meeting place, and a place to permit pedestrian shoppers to view the goods at their leisure prior to making purchases.

The shopping establishment 2 operates in the following manner. An automobile 34 enters the shopping establishment 2 from the public road 20 and proceeds along throughway 6 in search of that vendor from which the motorist wishes to make a purchase. Upon locating that vendor, identified by signs or other indicia (not shown), the automobile 34 enters the appropriate stack lane 10. The buildings in which the vendors do business are identified as numbers 40, 42, 44, 46, 48, 50, 52 and 54 in a counterclockwise fashion from the top of the figure. An automobile 34 entering ordering lane 8 at building 42, for example, places an order at the order station 44*a*. This station may be either a window staffed by an employee who is in communication with those employees arranging the transfer of goods, or alternatively an order board (or the like) connected by audio and/or video link to the goods transfer station. The automobile proceeds along ordering lane 8 to the pick-up window 44*b*, located in building 44. After picking up the goods, the automobile 34 proceeds out ordering lane 8, past stack lane 10 and onto throughway 6 to either proceed to a different building to make another purchase or to leave the shopping establishment 2.

It is possible that in one embodiment of the invention a single vendor may maintain operating facilities in two separate buildings. In this embodiment, it can be appreciated that the vendor will require minimum space for taking orders. Thus, for example, a single vendor located in both buildings 42 and 44 will occupy the majority of building 44 where the goods are transferred to the motorist. The vendor selling in building 44 would occupy only a small portion of building 42 merely for the purpose of taking the order.

In the depicted configuration, buildings 40 and 48 serve only to take the orders from motorists, either by an attendant at an order window, or by an order board positioned on or near an external wall along the ordering lane 8. Buildings 40 and 48 are included to demonstrate that facilities without drive-through pick-up capabilities may still operate within the confines of this type of shopping establishment. Buildings 46 and 54 serve only to transfer goods to the motorists. Because of the minimal space required for the placing of orders, buildings 40 and 48 may be retail outlets servicing only walk-in or carry-out business, or they may be used for other purposes within the shopping establishment 2, such as for administration, maintenance item storage, merchandise storage or the like. It can be appreciated that an alternative configuration more closely approaching a circle would permit each of the buildings to have both order and pick-up windows, thus maximizing the potential sales volume of the shopping establishment 2.

To better define the ordering lane 8 and provide separation of that lane from the stack lane 10, border areas 60 are provided throughout the shopping establishment 2. These areas may optionally be landscaped to improve the aesthetic appearance of the shopping establishment 2. For those individuals wishing to frequent the commons area 26, on-street parking may be provided near the shopping establishment, or alternatively a parking area 62 may be provided. In another embodiment, the parking area may be below the shopping establishment. Those motorists wishing to transport passengers as close as possible to the commons area 26 may do so by driving to and stopping in one of the two drop off lanes 64.

The shopping establishment as depicted is located on a flat parcel of land to maximize visibility and use of space, but alternatively the establishment may include tiered buildings on sloping plots of land. The establishment may be under a common roof, and may further be used to comprise the ground level of a development of more than one floor built above the establishment.

Thus, it is apparent that there has been provided, in accordance with the invention, a shopping establishment that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A multi-building shopping establishment for purchasing goods from various vendors from within a vehicle comprising:

a plot of land with public road access thereto;

a central complex on said plot having a plurality of discrete buildings wherein in at least one of said buildings both the ordering and the receiving of goods is accomplished, wherein an order for goods is placed at a building separate from the building at which the goods are received;

a throughway inside the perimeter of said plot connected to said public road;

at least one ordering lane between said complex and said throughway, connecting said building at which said order is placed with said building at which said goods are received; and a stack lane between said ordering said throughway for accepting additional vehicles prior to the placing of said orders for said goods.

2. The establishment of claim 1 wherein each said building offers ready-to-eat food products.

3. The establishment of claim 1 wherein said central complex has a sit-down eating area located therein.

4. The establishment of claim 1 wherein each said ordering lane has a V-shape defined by said buildings at which said order is placed and said goods are received on one side and a border area on the opposite side.

5. The establishment of claim 1 wherein said stack lane and said ordering lane in combination has a length sufficient to hold up to seven vehicles, wherein said vehicles are automobiles.

6. The establishment of claim 1 wherein said throughway has a rectangular shape.

7. The establishment of claim 4 wherein said ordering lanes in combination present a saw tooth shape along said throughway.

8. A multi-building shopping establishment for purchasing ready-to-eat food products from various vendors from within a vehicle comprising:

a plot of land with public road access thereto;

a central complex on said plot having a plurality of discrete buildings for both the ordering and receiving of ready-to-eat food products, wherein an order for said food products is placed at the building adjacent to the building at which said food products are received;

a throughway inside the perimeter of said plot connected to said public road;

at least one ordering lane between said complex and said throughway, connecting said building at which said order is placed with said building at which said goods are received; and a stack lane between said ordering lane and said throughway for accepting additional vehicles prior to the placing of said orders for said goods.

9. The establishment of claim 8 wherein said central complex has a sit-down eating area located therein.

10. The establishment of claim 8 wherein each said ordering lane has a V-shape defined by said adjacent buildings on one side and a border area on the opposite side.

11. The establishment of claim 8 wherein said stack lane and said ordering lane in combination has a length sufficient to hold up to seven vehicles, wherein said vehicles are automobiles.

12. The establishment of claim 8 wherein said throughway has a rectangular shape.

13. The establishment of claim 10 wherein said ordering lanes in combination present a saw tooth shape along said throughway.

* * * * *

UNITED STATES PATENT AND TRADEMARK OFFICE

CERTIFICATE OF CORRECTION

PATENT NO. : 4,901,482

DATED : February 20, 1990

INVENTOR(S) : Carleen L. Lockard and Thomas W. Hefley

It is certified that error appears in the above-identified patent and that said Letters Patent is hereby corrected as shown below:

In the Abstract, delete "having" and insert -- comprised of --.

Col. 2, line 51, "automobile" should be -- automobiles --.

Col. 5, line 5, after "ordering" insert -- lane and --.

Signed and Sealed this

Tenth Day of August, 1993

*Attest:*

*Attesting Officer*

Michael K. Kirk

MICHAEL K. KIRK

*Acting Commissioner of Patents and Trademarks*